United States Patent [19]

Johansson

[11] Patent Number: 4,832,766

[45] Date of Patent: May 23, 1989

[54] METHOD OF CONTROLLING CHEMICAL REACTIVITY AND PRODUCTS PRODUCED BY SUCH METHOD

[75] Inventor: Stig Johansson, Jönköping, Sweden

[73] Assignee: Intermatch Sweden AB, Sweden

[21] Appl. No.: 68,969

[22] Filed: Jul. 1, 1987

[30] Foreign Application Priority Data

Jul. 4, 1986 [SE] Sweden ..... 8602984

[51] Int. Cl.[4] ..... C06B 29/02

[52] U.S. Cl. ..... 149/77; 149/29; 149/31; 149/108.6; 149/109.4; 149/109.6

[58] Field of Search ..... 149/108.6, 77, 109.6, 149/109.4, 29, 31

[56] References Cited

U.S. PATENT DOCUMENTS 3,701,697 10/1972 Galler et al. ..... 149/77

OTHER PUBLICATIONS

J. T. Dickinson, L. C. Jensen, and M. R. McKay, "Neutral Molecule Emission from the Fracture of Crystalline MgO," Department of Physics, Washington State University, Pullman, Washington, Abstract 456, AS3--ThA7.

C. N. Rowe and W. R. Murphy, "Mechano-Chemistry in Tribology," NSF Proceedings Tribology Workshop, pp. 327-401, (1974).

J. T. Dickinson, "Fracto-Emission Accompanying Adhesive Failure," Adhesives Chemistry, pp. 193-243, Plenum Publishing Corporation, 1984.

J. T. Dickinson and L. C. Jensen, "Fracto-Emission from Filled and Unfilled Polybutadiene," Journal of Polymer Science: Polymer Physics Edition, vol. 23, 873-888, (1985).

*Primary Examiner*—Stephen J. Lechert, Jr.

*Attorney, Agent, or Firm*—Lerner, David, Littenberg, Krumholz & Mentlik

[57] ABSTRACT

This invention relates to methods of controlling the generation and flow of fracto-emitted particles, preferably exo-electrons for purpose of enhancing chemical reactivity, e.g., the sensitivity of friction matches, or for purpose of diminishing chemical reactivity, e.g., stabilizing of explosives.

17 Claims, No Drawings

METHOD OF CONTROLLING CHEMICAL REACTIVITY AND PRODUCTS PRODUCED BY SUCH METHOD

Enhanced chemical reactivity is accomplished by adding material with high fracto-emission activity, i.e., materials which emit positive and/or negative particles when fragmented by physical action.

Decreased chemical reactivity is accomplished by quenching of particles emitted from solids, such as crystalline materials, present in a chemical composition such as explosives.

One object of the invention is to reduce the manufacturing cost of pyrotechnic matches with retained, or even increased safety in handling and with perfectly satisfactory sensitivity of striking. In addition, the object is to eliminate or reduce the content of toxic substances in the match head composition.

The mechanism of ignition of pyrotechnic friction matches is incompletely known. Qualitative accounts of the ignition process usually include one or more of the following physical events or steps taking place during the striking process:

(1) a reactive powder mixture is produced.
(2) the components of the powder mixture are subjected to mechanical pressure as the match head is pressed against the friction surface.
(3) mechanical heat of friction is generated
(4) energetic electrons are emitted from freshly formed fractures of component particles in the match head composition.
(5) evaporation of phosphorus which results in tetrameric gas molecules, $P_4(g)$.

Steps (1) through (4) apply to all types of pyrotechnic friction matches. Step (5) can occur only in those cases when elementary phosphorus is present in the match head composition or in the friction composition. Since the use of the poisonous white phosphorus, $P_4(s)$, as a match chemical is prohibited by law, elementary phosphorus is used in match production in its red, non-poisonous form only, P(red), and then exclusively in the friction composition of safety matches.

For safety matches, Step (5) can be described as follows: when the match head is struck against the phosphorus friction a small amount of red phosphorus is evaporated. This may remain in the gaseous phase or be re-condensed onto the head. Either way it is in a pyrophoric form, i.e., $P_4(g)$ or $P_4(s)$, and ignites easily in contact with oxygen in the air and triggers thereby the pyrotechnic reaction in the composition.

For strike anywhere matches, which are lighted on inert friction surfaces, Step (5) is excluded. Lately its importance as far as safety matches are concerned has been strongly questioned.

Of the other steps, (3) is often considered to be the only one of importance, but Steps (1) and (2) probably also contribute.

Step (1) creates the basic chemical condition for the ignition process by bringing about good mechanical contact between the oxidizing agent and the tinder.

Potassium chlorate, $KClO_3(s)$, is the proferred oxidizing agent in the ignition composition of matches. This substance possesses high oxidation potential relative to the majority of combustible substances. The tinder is a substance, which is relatively easy to set on fire, such as red phosphorus, sulphur, and tetraphosphorus trisulphide, $P_4S_3(s)$. Red phosphorus can be found in the friction surface of safety matches, $P_4S_3(s)$ in the ignition composition of strike anywhere-so called sesqui-matches.

Step (2) improves the contact between oxidizer and tinder, and the heat evolved by Step (3) provides the activation energy required for the ignition process. Due to the fact that the activation energy of reaction between $KClO_3(s)$ and P(red) or between $KClO_3(s)$ and $P_4S_3(s)$ is low (these reactions could be even hypergolic, i.e., their activation energy could be zero), a lower temperature is required for causing pyrotechnic ignition of the match head composition than is required for purely thermal ignition. As far as sesqui matches and safety matches are concerned, thermal ignition occurs at about 170° C. and about 200° C., respectively. In purely thermal ignition of the head of safety matches, P(red) does not participate, but instead sulphur and/or organic binders.

The generation of electrons, Step (4), during the fracture of solids is called the Kramer effect after its discoverer. However, bearing in mind the object mentioned in the introduction, this provides a hitherto unnoticed ignition mechanism, viz., the stimulation of a pyrotechnic reaction by emitted exo-electrons.

Practical tests have corrobated that the emitted, so called exo-electrons, contribute to the ignitition of the match head and that this contribution increases with increasing exo-electron activity.

Fillers previously used in commercial match production so far show little or no exo-electron activity.

In order to utilize the possibilities of the Kramer effect in the present context, a pyrotechnic friction match is proposed characterized by a match head composition comprising at least one substance possessing high exo-electron activity, which thereby increases the striking sensitivity.

A substance with high exo-electron activity is calcium fluoride, $CaF_2(s)$, pure or in the form of fluorite, which has not previously been utilized as a match chemical before for this purpose, but which has now been found to be very suitable for the present object.

The degree of exo-electron activity can be measured according to a method shown by Kramer (Kramer, J.: "Untersuchungan mit dem Geiger-Spitzenzähler an bearbeiten Nichtmetallen", Zeitschrift fUr Physik 128 (1950) 538–545); after mechanical treatment or crushing of particles of substance the electron radiation is measured by means of a Geiger counter.

Another object of the invention is to stabilize hazardous materials, particularly explosives, by neutralising charged fracto-emission particles. In an explosive, such particles can be generated by inadvertent mechanical action and lead to detonation. Accidents of this kind can be prevented by adding, e.g., p-doped substances to explosives giving negative fracto-emission particles, such as exo-electrons, and n-doped substances for explosives giving positive fracto-emission particles, such as positive ions.

EXAMPLE 1

Tests with safety match head composition have shown that fluorite contributes to the striking sensitivity as much as does the same amount of potassium dichromate $K_2Cr_2O_7(s)$. As far as the striking sensitivity is concerned, a chromium-free match head composition can thus be achieved by substituting non-poisonous $CaF_2(s)$ for toxic $K_2Cr_2O_7(s)$.

EXAMPLE 2

Even substituting fluorite for common silica fillers resulted in increased striking sensitivity.

EXAMPLE 3

If fluorite is added to the friction composition rather than to the match head composition the striking sensitivity is not increased. This shows that the effect works as expected: exo-electrons emitted from the friction composition have no time to influence the disappearing match head when it moves along the friction surface.

EXAMPLE 4

Increased striking sensitivity of matches was brought about by addition of fluorite. This sensitivity was counteracted by reducing the amount of $KClO_3(s)$ correspondingly. The result was pyrotechnic friction matches which were safer to handle and cheaper to manufacture in full-scale production.

EXAMPLE 5

P-doped silicon was added to an exo-electronically active match head composition containing fluorite. The result was decreased striking sensitivity. This experiment shows that emitted exo-electrons can be absorbed in a quencher before they get an opportunity to initiate a chemical ignition reaction in a reactive system.

We claim:

1. A pyrotechnic friction match head comprising a substance having high exo-electron activity thereby resulting in the generation of fracto-emitted particles therein so as to increase the striking sensitivity of said friction match head.

2. The pyrotechnic friction match head of claim 1 wherein said substance having high exo-electron activity comprises calcium fluoride.

3. The pyrotechnic friction match head of claim 1 comprising potassium chlorate, the amount of said potassium chlorate being reduced by the presence of said substance having high exo-electron activity therein.

4. The pyrotechnic friction match head of claim 1 substantially free of a material capable of absorbing exo-electrons so as not to inhibit said exo-electron activity.

5. A method of increasing the reactivity of a chemical composition sensitive to stroke, shock or rubbing comprising adding a substance generating a flow of fracto-emitted exoelectrons to said system.

6. The method of claim 5 wherein said system comprises a pyrotechnic or explosive system.

7. A method of sensitizing a pyrotechnic or explosive system comprising incorporating into said system an exoelectronically active substance which generates fracto-emitted exoelectrons whereby the reactivity of said pyrotechnic or explosive system is enhanced.

8. The method of claim 7 including stimulating said generation of said fracto-emitted exoelectrons by mechanically treating said exoelectronically active substance.

9. A method of decreasing the reactivity of a pyrotechnic or explosive system which includes an exoelectrically active substance which generates fracto-emitted exoelectrons, said method comprising controlling the flow of said fracto-emitted exoelectrons by incorporating into said pyrotechnic or explosive system a material capable of absorbing exoelectrons.

10. The method of claim 9 wherein said material capable of absorbing exoelectrons therefrom comprises a p-doped material.

11. The method of claim 7 wherein said material capable of generating exoelectrons comprises an n-doped material.

12. A product capable of undergoing a pyrotechnic or explosive reaction at predetermined conditions comprising a substance having high exoelectron activity thereby resulting in the generation of fracto-emitted exoelectrons at said predetermined conditions so as to stimulate said pyrotechnic or explosive system at said predetermined conditions.

13. A product capable of undergoing a pyrotechnic or explosive reaction at predetermined conditions comprising a substance capable of absorbing exoelectrons therefrom in order to quench said pyrotechnic or explosive reaction at said predetermined conditions.

14. The method of claim 5 wherein said substance comprises calcium fluoride.

15. A method of decreasing the reactivity of a chemical composition sensitive to stroke, shock or rubbing comprising adding a substance controlling a flow of fracto-emitted exoelectrons to said system.

16. The method of claim 15 wherein said system comprises a pyrotechnic or explosive system.

17. The method of claim 15 wherein said substance comprises a p-doped material.

* * * * *

UNITED STATES PATENT AND TRADEMARK OFFICE

Certificate

Patent Number: 4,832,766

Patented: May 23, 1989

On petition requesting issuance of a certificate of correction of inventorship pursuant to 35 USC 256, it has been found that the above-identified patent, through error and without and deceptive intent, improperly sets forth the inventorship. Accordingly, it is hereby certified that the correct inventorship of this patent is:
Stig Johansson and Ake Fromell Signed and Sealed this 20th Day of March, 1990

BROOKS HUNT

*Supervisory Patent Examiner*
*Art Unit 224*